US011158478B2

(12) United States Patent
Betti

(10) Patent No.: US 11,158,478 B2
(45) Date of Patent: Oct. 26, 2021

(54) ELECTRIC FUSE

(71) Applicant: Audio Ohm di Tonani Caterina & C. S.r.l., Codogno (IT)

(72) Inventor: Bruno Betti, Codogno (IT)

( * ) Notice: Subject to any disclaimer, the term of this patent is extended or adjusted under 35 U.S.C. 154(b) by 0 days.

(21) Appl. No.: 17/070,143

(22) Filed: Oct. 14, 2020

(65) Prior Publication Data

US 2021/0118639 A1 Apr. 22, 2021

(30) Foreign Application Priority Data

Oct. 16, 2019 (IT) ..... 102019000018947

(51) Int. Cl.
*H01H 85/175* (2006.01)
*H01H 85/38* (2006.01)
*H01H 85/143* (2006.01)

(52) U.S. Cl.
CPC ..... *H01H 85/1755* (2013.01); *H01H 85/38* (2013.01); *H01H 85/143* (2013.01); *H01H 2085/383* (2013.01)

(58) Field of Classification Search
CPC .... H01H 85/08; H01H 85/143; H01H 85/175; H01H 85/1755; H01H 85/38; H01H 2085/383
See application file for complete search history.

(56) References Cited

U.S. PATENT DOCUMENTS 10,553,387 B1 * 2/2020 Angelini ..... H01H 85/38
2012/0133478 A1 * 5/2012 Chiu ..... H01H 85/165 337/228
2016/0141140 A1 * 5/2016 Schmidt ..... H01H 85/38 337/187
2016/0172143 A1 * 6/2016 Yoneda ..... H01H 85/143 337/186
2016/0217960 A1 * 7/2016 Abad ..... H01H 85/175
2018/0138004 A1 5/2018 Schlaak
2018/0174791 A1 * 6/2018 Kawai ..... H01H 85/185
2018/0294125 A1 * 10/2018 Yoneda ..... H01H 85/0056
2019/0267207 A1 * 8/2019 Jaster ..... H01H 85/2025

FOREIGN PATENT DOCUMENTS

DE 3885492 3/1994
KR 20190057796 5/2019
WO 2019144711 8/2019

OTHER PUBLICATIONS

Italian Patent and Trademark Office, Search Report, dated Jun. 3, 2020 (Relevant portions are in English).

* cited by examiner

*Primary Examiner* — Jacob R Crum
(74) *Attorney, Agent, or Firm* — Themis Law

(57) ABSTRACT

A safety fuse for use in a motor vehicle includes which fuse comprises a first contact metal portion, a second contact metal portion and a melting metal section connecting the first contact portion to the second contact portion. The melting section is enclosed by a casing made from a non-conductive material and includes two hollow half-shells provided with mutual coupling elements, each half-shell having an inner surface facing the melting section and an outer surface facing outside of the fuse. At least one of the half-shells is provided on at least part of the inner surface of an alveolar structure with open cells in the direction of the melting section. The alveolar structure is formed by a plurality of walls protruding from the inner surface and intersected with each other.

12 Claims, 5 Drawing Sheets

ELECTRIC FUSE

FIELD OF THE INVENTION

The present invention relates to an electric safety fuse for use in a motor vehicle.

BACKGROUND OF THE INVENTION

Such safety fuses are currently known and are used to protect an electrical circuit from an overcurrent.

One type of fuse currently known and used in motor vehicles is the so-called MIDI fuse, an example of which is illustrated in the assembled condition in FIG. 1.

This fuse has a first contact metal portion, a second contact metal portion, and a melting section connecting the first contact portion with the second contact portion to form a single metal part. The first contact portion, the second contact portion, and the melting section lie on a common plane.

The melting section is enclosed by a casing made of a non-conductive material, preferably polymeric material. At least part of the first contact portion and at least part of the second contact portion freely protrude from the casing along the same direction in respective opposite directions.

The casing protrudes with respect to the common plane on both sides of the plane, for about the same distance from the plane on both sides. The casing consists of two hollow half-shells provided with removable mutual coupling means. Each half-shell then has an inner surface facing the melting section and an outer surface facing outside the fuse.

The mutual contact edges of the two half-shells have complementary shapes for a shape coupling in a closed condition, and the removable reciprocal coupling means typically comprise one or more pins adapted to penetrate into corresponding holes or alternatively holes with rivets.

The fuse also generally provides a hole in the part of the first contact portion protruding from the casing, which hole allows the fixing of the fuse, by means of a screw or the like, to a special support outside the fuse. Two holes may be provided, each on a contact portion, or no holes may be provided.

When an overcurrent occurs which exceeds the amperometric flow rate of the fuse, the melting section melts, causing the circuit to open, securing the electrical devices connected to the circuit and the entire vehicle.

However, it is possible that between the two contact portions, once separated from the melting of the intermediate section, an electric arc develops. This phenomenon effectively closes the circuit and can generate a situation of great danger. Experimental evidence suggests that during the melting of the intermediate section, some of the metal material sublimates, creating a dispersion of dust inside the casing. Such metallic-based dust dispersion inside the casing would be sufficient to promote the occurrence of the electric arc phenomenon between the two fuse ends.

A similar phenomenon is taken into account by document KR20190057796A, which detects how sparks created by the sublimation of the melting section can deposit particles on the inner surface of the casing. If these particles are arranged to be electrically connected together, they may reduce the effectiveness of the fuse. The document therefore discloses a fuse with inserts provided on the inner surface of the two half-shells, which inserts are provided with hemispherical protrusions projecting in the direction of the melting section. The presence of said protrusions increases the particle deposition surface and thus minimizes the likelihood that the particles can be electrically connected to each other.

However, this solution does not take into account the suspended dust particles, and the mere presence of hemispherical protrusions, designed to increase the area of the inner surface of the casing, leaves the open space inside the casing substantially unchanged and does not sufficiently limit the movements and possible electrical connections between such suspended particles. This results in reduced performance, which does not guarantee a satisfactory minimization of the risk of the electric arc occurrence.

There is therefore currently an unmet need by the state-of-the-art fuses to eliminate or at least significantly reduce the possibility of electric arcs occurring between the fuse ends after melting.

SUMMARY OF THE INVENTION

The present invention seeks to overcome these drawbacks of the currently known fuses with a simple and inexpensive solution.

The present invention achieves such objects with a safety fuse for use in a motor vehicle, which fuse comprises a first contact metal portion, a second contact metal portion and a melting metal section connecting the first contact portion with the second contact portion. The melting section is enclosed by a casing consisting of a non-conductive material, which casing is composed of two hollow half-shells provided with mutual coupling means, each half-shell having an inner surface facing the melting section and an outer surface facing outside the fuse. At least one said half-shell is provided on at least part of the inner surface of an open-cell alveolar structure, which cells are open in the direction of the melting section, the alveolar structure being composed of a plurality of walls protruding from said inner surface and intersected with each other.

The alveolar structure divides the inner space of the casing surrounding the melting section into separate subspaces, so that after melting, the metal-based dust cannot freely disperse throughout the inner space of the casing, but remains confined in cells separate from each other. This technical effect significantly reduces the possibility of triggering an electric arc between the fuse ends.

In one embodiment the alveolar structure is provided only in the half-shell portion facing the melting section.

According to a further embodiment, the first contact portion, the second contact portion and the melting section lie on a common plane and said walls are perpendicular to said common plane.

In one embodiment the top edges of said walls define a surface of the alveolar structure, which surface of the alveolar structure is flat and parallel to said common plane. Top edge of the wall is intended as the edge of the wall which is not constrained to the inner surface of the half-shell.

In a further embodiment, in the assembled condition of the fuse, said surface of the alveolar structure is closer to the melting section than to the inner surface of the respective half-shell.

In one embodiment, the walls are arranged perpendicular to each other and form rectangular-base cells.

According to an improvement, the walls form square-base cells.

In a preferred embodiment, the walls are made of non-conductive material.

According to a preferred embodiment, the walls forming the alveolar structure are integrally formed with the related half-shell, preferably by moulding, for example injection moulding.

In one embodiment, the melting section is shaped according to a loop and the casing in the assembled condition of the two half-shells has an intermediate wall, which intermediate wall is positioned inside said loop and is connected to both half-shells.

The intermediate wall helps to increase the insulation between the fuse ends after melting, helping to avoid the occurrence of the electric arc.

According to one embodiment, said intermediate wall is integrally formed with one of the two half-shells.

In a further embodiment, at least part of the first contact portion and at least part of the second contact portion freely protrude from the casing in respective opposite directions along a common straight direction, said intermediate wall provided being arranged perpendicular to said straight direction in the assembled condition of the casing.

In this manner, the intermediate wall is placed transverse to the direction which joins the two fuse ends and acts as a non-conductive barrier.

Experimental tests have shown that the insulation exhibited upon melting acquires a significant increase for the fuses object of the present invention.

In particular, in the event of an insulation greater than 1 MOhm required by the current standards of automotive manufacturers, the tested fuses provided with an alveolar structure and an intermediate wall have revealed an insulation well above the requirements.

Repeated test results on a significant plurality of fuses with and without alveolar structure confirmed that all the fuses with alveolar structure always exhibited an insulation greater than 1 MOhm.

These tests confirm that the presence of the alveolar structure confers a significant increase in the insulation guaranteed by the fuse.

BRIEF DESCRIPTION OF THE DRAWINGS

These and other features and advantages of the present invention will become clearer from the following description of some non-limiting exemplary embodiments illustrated in the attached drawings in which.

DETAILED DESCRIPTION OF EMBODIMENTS OF THE INVENTION

Figure 1:
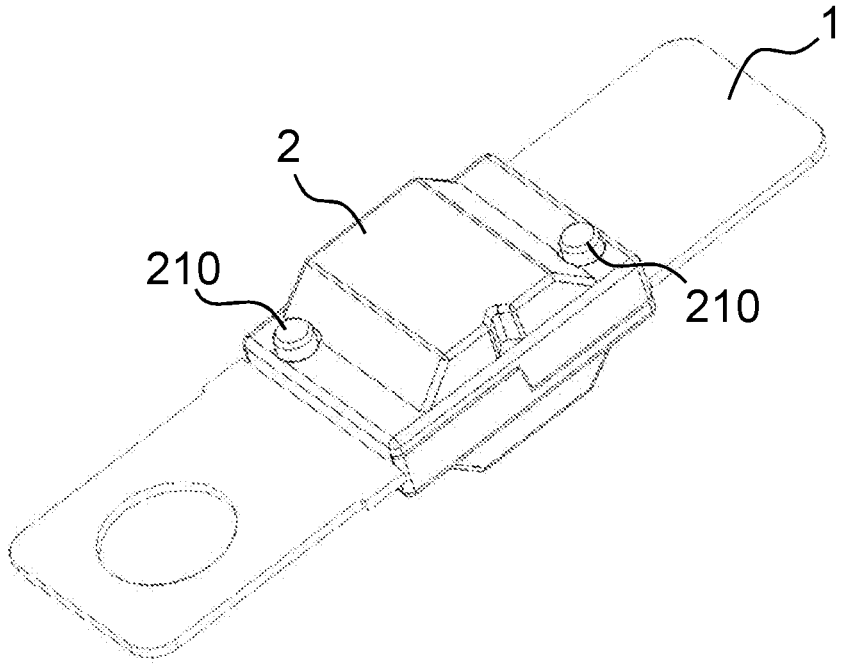
FIG. 1 illustrates the fuse in the assembled condition.
Figure 2:
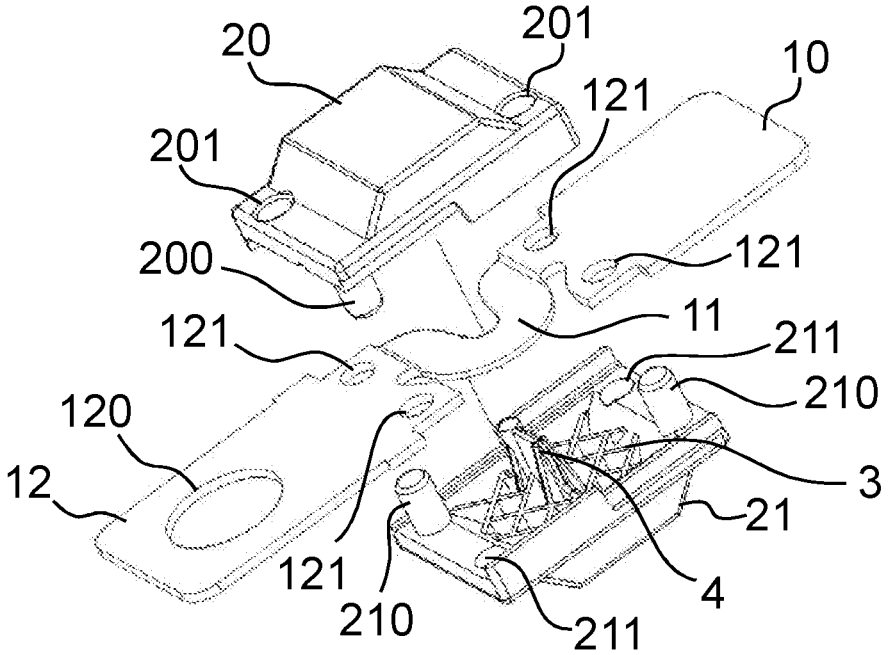
FIG. 2 illustrates an exploded view.
Figure 3:
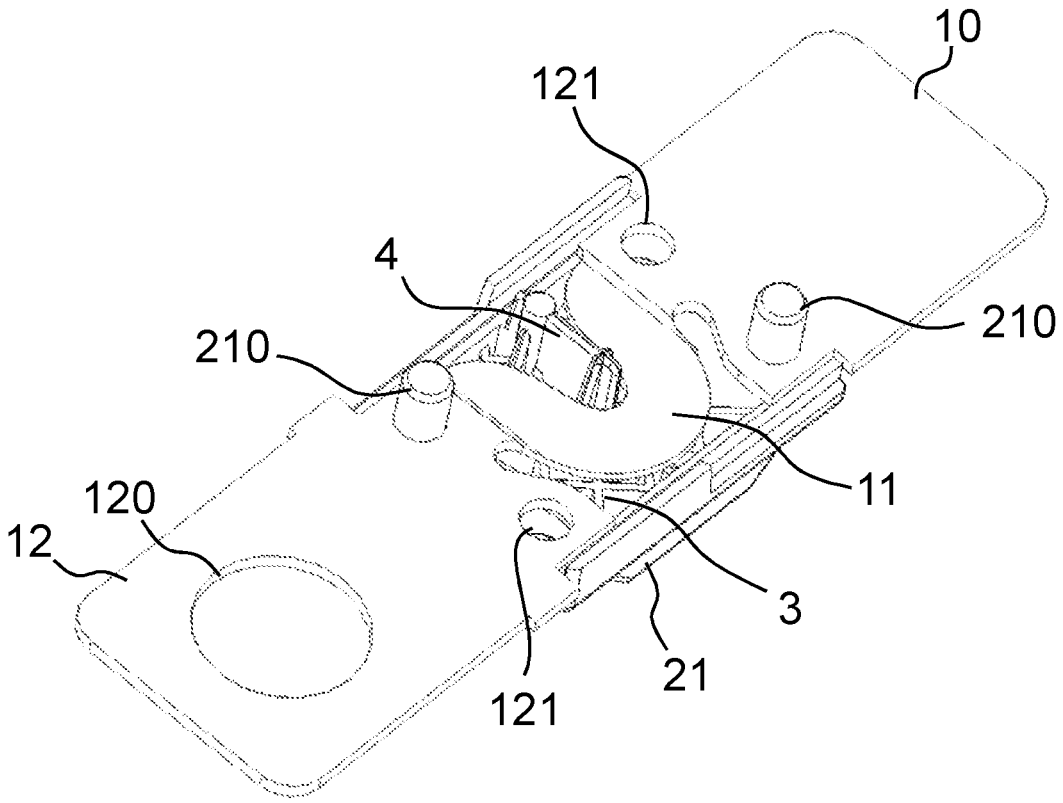
FIG. 3 illustrates the assembly of the metal part and the first half-shell.
Figure 4:
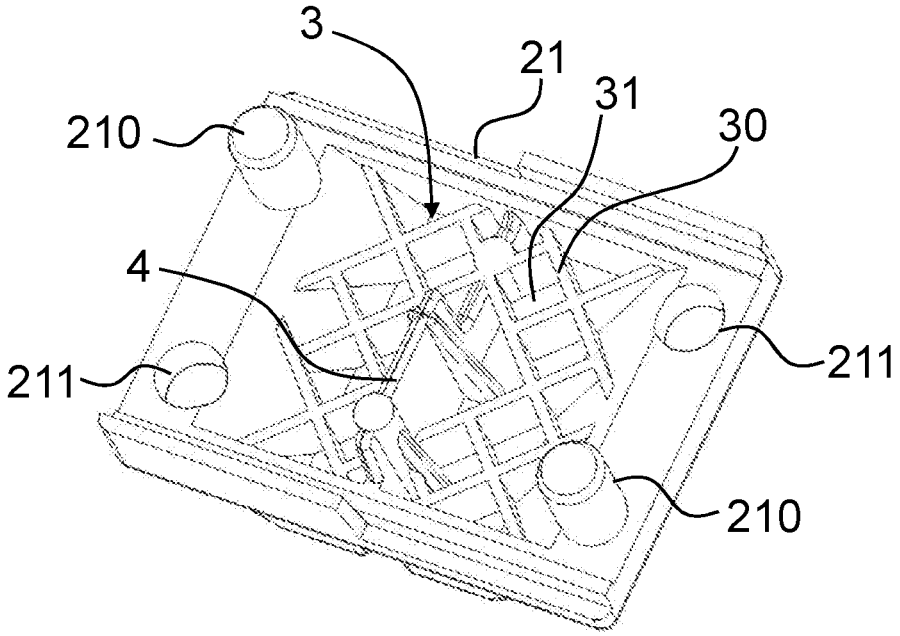
FIGS. 4 and 5 illustrate different views of the first half-shell.
Figure 5:
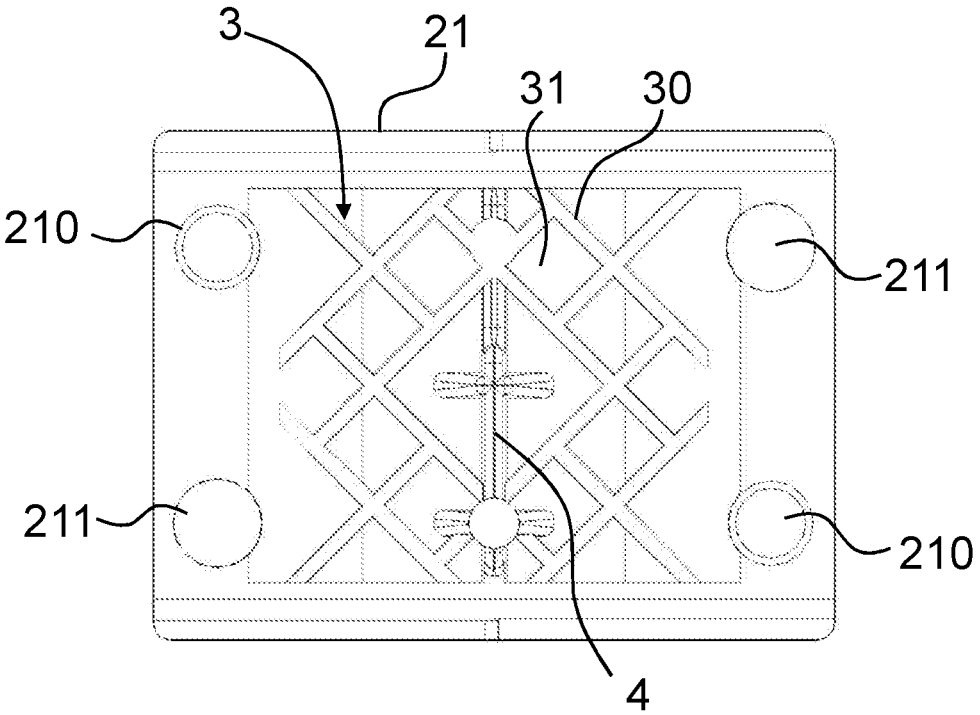
Figure 6:
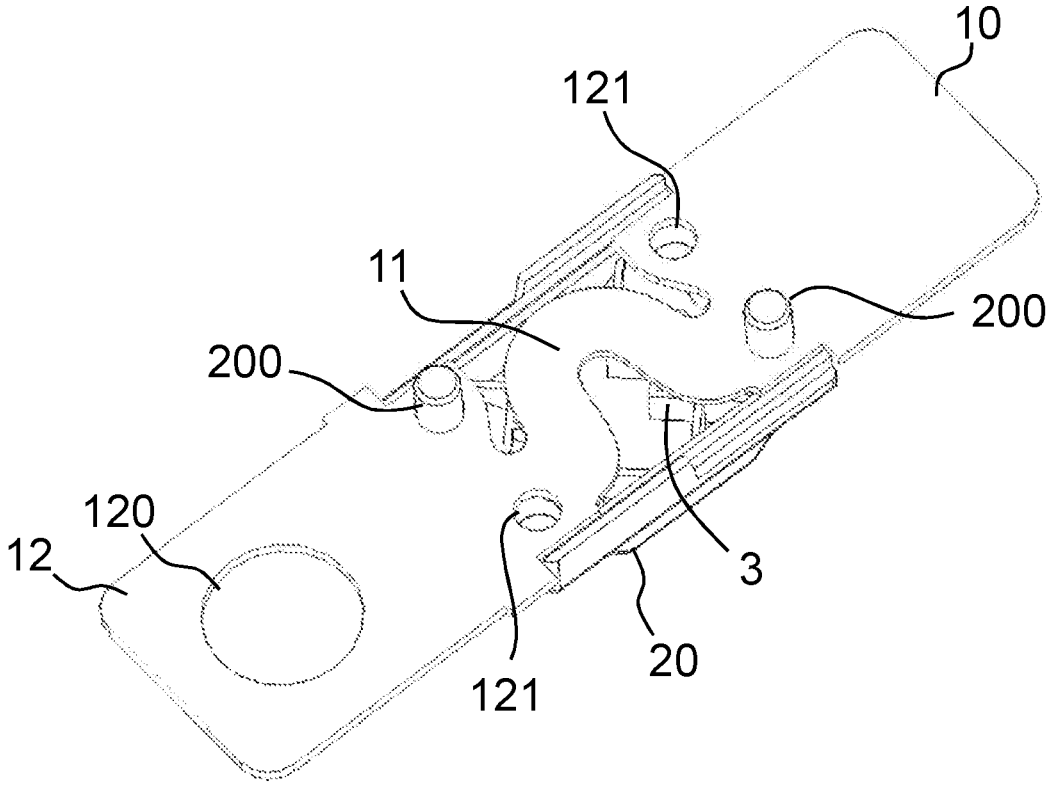
FIG. 6 illustrates the assembly of the metal part and the second half-shell.
Figure 7:
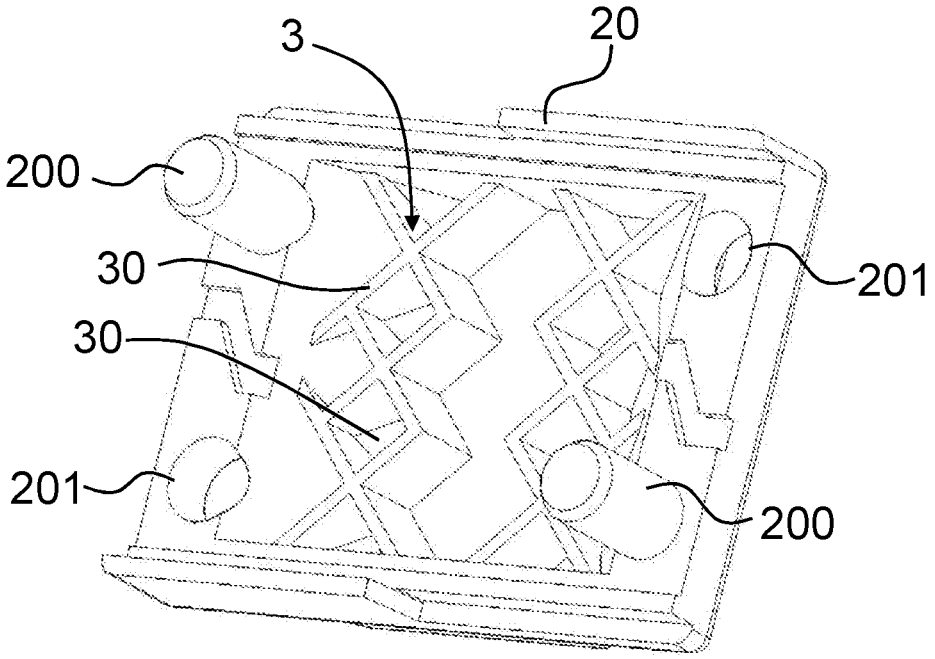
FIGS. 7 and 8 illustrate different views of the second half-shell.
Figure 8:
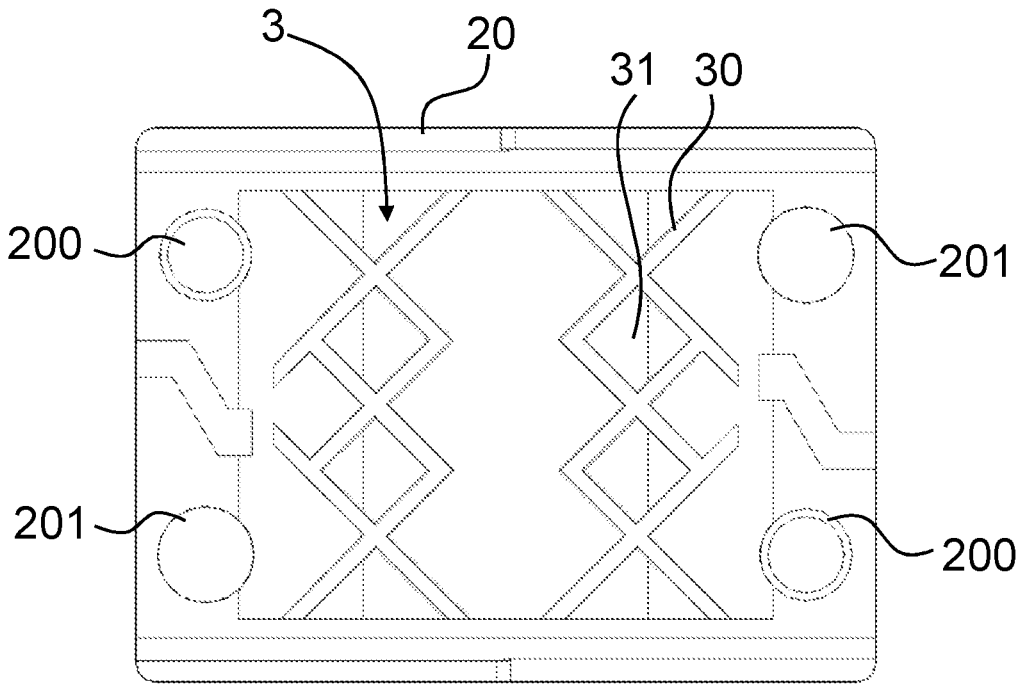

An embodiment example is illustrated in the figures of the safety fuse for use in a motor vehicle according to the present invention.

The fuse comprises a conductive metal part 1 consisting of joining a first contact metal portion 10, a second contact metal portion 12 and a melting metal section 11 connecting the first contact portion 10 with the second contact portion 12. The contact portions 10 and 12 are plate-like. The first contact portion 10, the melting section 11 and the second contact portion 12 lie on a common plane, and the metal portion 1 therefore consists of a flat and suitably shaped metal plate. The shape is such that the melting section 11 is shaped according to a loop. The metal part 1 may be of any metal material suitable for use in a safety fuse, preferably it consists of tinned copper.

However, other geometries may also be provided, for example the contact portions 10 and 12 may also not lie on a common plane.

The melting section 11 is enclosed by a casing 2 made of a non-conductive material. Any non-conductive material suitable for use to enclose the melting section 11 of the fuse may be used, for example a polymer. Preferably, the non-conductive material is a glass fibre reinforced polyamide, in particular with a glass fibre content between 30 and 50%.

The first contact portion 10 and the second contact portion 12 freely protrude from the casing 2 in respective opposite directions along a common straight direction. It is possible that the contact portions 10 and 12 completely protrude from the casing 2 or alternatively that the contact portions 10 and 12 only partially protrude from the casing 2. An alternative configuration may also be provided in which the contact portions do not protrude in opposite directions of the same straight direction, but for example form an angle, a U-shaped configuration, an S-shaped configuration in which the contact portions protrude in opposite directions perpendicular to the longitudinal axis of the melting section 11, or the like.

The casing 20 consists of a first hollow half-shell 20 and a second hollow half-shell 21. Each half-shell 20 and 21 has an inner surface facing the melting section 11 and an outer surface facing outside the fuse.

In the preferred embodiment illustrated in the figures, the two half-shells 20 and 21 have respective mutual contact edges which have complementary shapes for a shape coupling in the closed condition of the casing 2.

The two half-shells 20 and 21 are also provided with removable mutual coupling means comprising two first pins 200 and two second pins 210 provided on the inner surfaces of the first half-shell 20 and the second half-shell 21, respectively, which pins 200 and 210 each extend in the direction of the opposite half-shell.

The first half-shell 20 is provided with two first housing holes 201 of the second pins 210, while the second half-shell 21 is provided with two second housing holes 211 of the first pin 200, such that in the coupled condition of the two half-shells 20 and 21 each pin penetrates the corresponding hole provided on the opposite half-shell. This keeps the two half-shells 20 and 21 coupled in the closed condition of the casing 2.

The metal part 1 is provided with four holes 121 in which the pins 200 and 210 are inserted into the coupling of the two half-shells 20 and 21. Therefore, in the assembled condition the fuse has the metal part 1 and the casing 2 locked in the operating position thereof.

Although the embodiment presented is the preferred embodiment, it is still possible to provide for mutual coupling means of the two half-shells 20 and 21 which cannot be removed, in which the fuse, once assembled, can no longer be broken down into the constituent components thereof.

The half-shells 20 and 21 are provided on the inner surface of an open-cell alveolar structure 3, which cells 31 in the assembled condition of the fuse expose the opening thereof in the direction of the melting section 11.

In the preferred embodiment illustrated in the figures, both half-shells 20 and 21 are provided in the inner surface of the alveolar structure 3. However, it is possible to provide the alveolar structure 3 only on one half-shell. The alveolar structure 3 may also be provided on the entire inner surface or on at least part thereof. If the casing also covers part of the contact portions, the alveolar structure 3 is advantageously provided only at the melting section 11. The melting section 11 is covered on both sides and substantially in the entirety thereof by the alveolar structures 3 of the two half-shells 20 and 21 in the coupled condition.

The alveolar structure 3 consists of a plurality of walls 30 protruding from the inner surface of the respective half-shell 20 or 21, which walls 30 are intersected with each other to form said cells 31 open in the direction of the metal part 1 in the assembled condition of the fuse. In the embodiment of the figures, the walls 30 are positioned perpendicular to the common plane on which the metal part 1 lies and are arranged perpendicular to each other to form rectangular-base cells 31, in particular square-base cells 31. However, it is possible to envisage an alveolar structure 3 with other geometries, for example with rhomboidal or hexagonal cells, without departing from the objects of the present invention.

The top edges of the walls forming the alveolar structure 3 define a surface of the alveolar structure 3 itself. Such surface of the alveolar structure 3 is flat and parallel to the common plane on which the metal part 1 lies, and is closer to the melting section 3 than to the inner surface of the respective half-shell 20 or 21.

The walls 30 forming the alveolar structure 3 are integrally formed with the related half-shell 20 or 21, preferably by moulding, for example injection moulding. The walls 30 are thus made of the same non-conductive material which forms the casing 2. It is optionally possible to provide an alveolar structure 3 consisting of an independent element, of non-conductive material, which can be inserted inside the casing 2.

The alveolar structure 3 of the first half-shell 20 is divided into two parts separated from each other, to form in the centre a housing compartment in which an intermediate wall 4 integrally formed with the second half-shell 21 is positioned, in the assembled condition of the fuse.

In the assembled condition of the fuse, the intermediate wall 4 is positioned inside the loop formed by the melting section 11 and is provided perpendicular to the straight direction along which the two contact portions 10 and 12 protrude from the casing 2.

In the assembled condition of the casing 2, the intermediate wall 4 is at least partially in contact with the inner surface of the first half-shell 20, such that it is connected to both half-shells 20 and 21.

The invention claimed is:

1. A safety fuse for use in a motor vehicle, comprising:

a first contact metal portion;

a second contact metal portion; and a melting metal section connecting the first contact portion to the second contact portion, the melting metal section being enclosed by a casing made from a non-conductive material, the casing having two hollow half-shells provided with mutual coupling means, each half-shell having an inner surface facing the melting metal section and an outer surface facing outside of the fuse, wherein at least one of the two hollow half-shell is provided on at least part of an inner surface of an alveolar structure having open cells, said open cells being arranged in a plurality of rows and columns and being open in a direction of the melting metal section, the alveolar structure having a plurality of walls protruding from said inner surface and intersected with each other.

2. The fuse according to claim 1, wherein the alveolar structure is provided only in the half-shell facing the melting metal section.

3. The fuse according to claim 1, wherein the first contact metal portion, the second contact metal portion, and the melting section lie on a common plane and said walls are perpendicular to the said common plane.

4. The fuse according to claim 3, wherein top edges of said walls define a surface of the alveolar structure, which surface of the alveolar structure is flat and parallel to said common plane.

5. The fuse according to claim 4, wherein, in an assembled condition of the fuse, the ssurface of the alveolar structure is closer to the melting section than to the inner surface of the respective half-shell.

6. The fuse according to claim 1, wherein the walls are arranged perpendicular to each other and form rectangular-base cells.

7. The fuse according to claim 6, wherein the walls form square-base cells.

8. The fuse according to claim 1, wherein the walls are made of a non-conductive material.

9. The fuse according to claim 1, wherein the melting metal section is shaped according to a loop and the casing in an assembled condition of the two half-shells has an intermediate wall, the intermediate wall being positioned inside said loop and being connected to both half-shells.

10. The fuse according to claim 9, wherein said intermediate wall is integrally formed with one of the two half-shells.

11. The fuse according to claim 9, wherein at least part of the first metal contact portion and at least part of the second metal contact portion freely protrude from the casing in respective opposite directions along a common straight direction, the intermediate wall being provided arranged perpendicularly to the straight direction in an assembled condition of the casing.

12. The fuse according to claim 9, wherein the intermediate wall extends inside a cavity and across the casing, the intermediate wall having opposite sides each facing a plurality of the open cells.

* * * * *